US010865579B2

(12) United States Patent
Spicer et al.

(10) Patent No.: US 10,865,579 B2
(45) Date of Patent: Dec. 15, 2020

(54) COVER FOR A SPA

(71) Applicants: Wade Spicer, Northumberland, PA (US); Charles Woods, West Manchester, OH (US); Ryan Force, Nescopeck, PA (US)

(72) Inventors: Wade Spicer, Northumberland, PA (US); Charles Woods, West Manchester, OH (US); Ryan Force, Nescopeck, PA (US)

(73) Assignee: STRONG INDUSTRIES, INC., Northumberland, PA (US)

( * ) Notice: Subject to any disclaimer, the term of this patent is extended or adjusted under 35 U.S.C. 154(b) by 157 days.

(21) Appl. No.: 15/334,626

(22) Filed: Oct. 26, 2016

(65) Prior Publication Data

US 2017/0121992 A1 May 4, 2017

Related U.S. Application Data

(60) Provisional application No. 62/247,526, filed on Oct. 28, 2015.

(51) Int. Cl.
*E04H 4/08* (2006.01)

(52) U.S. Cl.
CPC ..... *E04H 4/084* (2013.01)

(58) Field of Classification Search
CPC ..... E04H 4/084; E04H 4/08; E04H 4/06
USPC ..... 4/498
See application file for complete search history.

(56) References Cited

U.S. PATENT DOCUMENTS 5,996,137 A * 12/1999 Genova ..... E04H 4/084 4/498
6,000,072 A * 12/1999 LaHay ..... E04H 4/084 4/498
6,032,305 A * 3/2000 Tedrick ..... E04H 4/084 220/817
6,634,036 B2 * 10/2003 Tudor ..... E04H 4/084 4/498
6,795,984 B1 * 9/2004 Brady ..... E04H 4/084 220/263
6,859,952 B2 * 3/2005 Perry ..... E04H 4/084 4/498
7,281,280 B2 * 10/2007 Lahay ..... E04H 4/084 4/498
7,752,685 B2 * 7/2010 Tudor ..... E04H 4/084 4/498
2006/0053543 A1 * 3/2006 Vargas ..... E04H 4/084 4/498
2013/0117922 A1 * 5/2013 Spicer ..... E04H 4/14 4/498
2014/0090163 A1 * 4/2014 Genova ..... E04H 4/084 4/498

(Continued)

*Primary Examiner* — Erin Deery
(74) *Attorney, Agent, or Firm* — Grogan, Tuccillo & Vanderleeden, LLP

(57) ABSTRACT

A cover for a spa includes a first cover member and a second cover member hingedly connected to one another about a seam. The cover further includes a sleeve associated with of one of the cover members at an approximate midpoint between an outer edge of the cover member and the seam. The sleeve is configured to receive a connecting rod of a lifting mechanism therethrough for transmitting an uncovering and/or covering force from the lifting mechanism to the cover.

8 Claims, 18 Drawing Sheets

(56) References Cited

U.S. PATENT DOCUMENTS

2015/0345163 A1* 12/2015 Cunerty ..... E04H 4/084
4/498
2016/0123028 A1* 5/2016 Cunerty ..... E04H 4/084
4/498

* cited by examiner

COVER FOR A SPA

CROSS-REFERENCE TO RELATED APPLICATIONS

This application claims the benefit of U.S. Provisional Application Ser. No. 62/247,526, filed on Oct. 28, 2015, which is herein incorporated by reference in its entirety.

FIELD OF THE INVENTION

The present invention relates generally to spas and, more particularly, to a cover for a spa.

BACKGROUND OF THE INVENTION

Spas, also commonly known as hot tubs, are popular fixtures that are used in many homes. They generally include a deep, vacuum formed tub having a smooth acrylic liner that is filled with heated water and which is used for soaking and relaxation. Spas typically include water jets for massage purposes.

Typically, the acrylic liner is formed into shapes that provide a variety of seating arrangements within the tub. Each seat is usually equipped with hydrotherapy jets that allow a pressurized flow of water to be directed at various parts of a user's body. The water flow may be aerated for additional effect, and some or all of the jets may also automatically move or rotate, causing the changing pressure of the water on the body to provide a massage-like effect.

Because many spas/hot tubs are located outdoors, they are often equipped with covers for enclosing the tub when not in use. These covers help prevent dirt, leaves and other debris from entering the water, and provide a safety function by preventing children and animals from falling into the water. Moreover, spa covers are often insulated so as to limit heat loss from the water when the spa is not in use for purposes of energy efficiency and readiness of use.

As will be readily appreciated, however, existing covers for spas are heavy and cumbersome, making them difficult for a user to remove prior to using the spa and to place back over the spa when it is no longer in use. In addition, existing cover lifting mechanisms are typically mounted to an exterior of the spa, where they can be unsightly and may be prone to damage.

In view of the above, there remains a need for a cover for a spa that is easier to remove and replace than existing covers, minimizes the number of exposed lifter components, and is aesthetically pleasing.

SUMMARY OF THE INVENTION

It is an object of the present invention to provide a cover for a spa.

It is another object of the present invention to provide a cover for a spa that is easier to remove and replace than existing covers.

It is another object of the present invention to provide a cover for a spa that is ergonomic.

It is another object of the present invention to provide a cover for a spa that minimizes the number of exposed lifter components.

It is another object of the present invention to provide a cover for a spa that is positioned close to the side of the spa and lowers substantially all the way to the ground when in a retracted position.

It is yet another object of the present invention to provide a cover that is capable of being retrofit onto existing spas.

According to an embodiment of the present invention, a cover for a spa is provided. The cover includes a first cover member and a second cover member hingedly connected to one another about a seam. The cover further includes a sleeve attached to the top of one of the cover members at an approximate midpoint between an outer edge of the cover member and the seam. The sleeve is configured to receive a connecting rod of a lifting mechanism therethrough for transmitting an uncovering and/or covering force from the lifting mechanism to the cover.

According to another embodiment of the present invention, a spa is provided. The spa includes a base, a shell supported by the base, a cover positionable atop the base, and a lifting mechanism attached to the base and operatively connected to the cover. The cover includes a first cover member and a second cover member hingedly connected to one another about a seam. The cover further includes a sleeve attached to the top of one of the cover members at an approximate midpoint between an outer edge of the cover member and the seam. The sleeve is configured to receive a connecting rod of a lifting mechanism therethrough for transmitting an uncovering and/or covering force from the lifting mechanism to the cover.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 1:
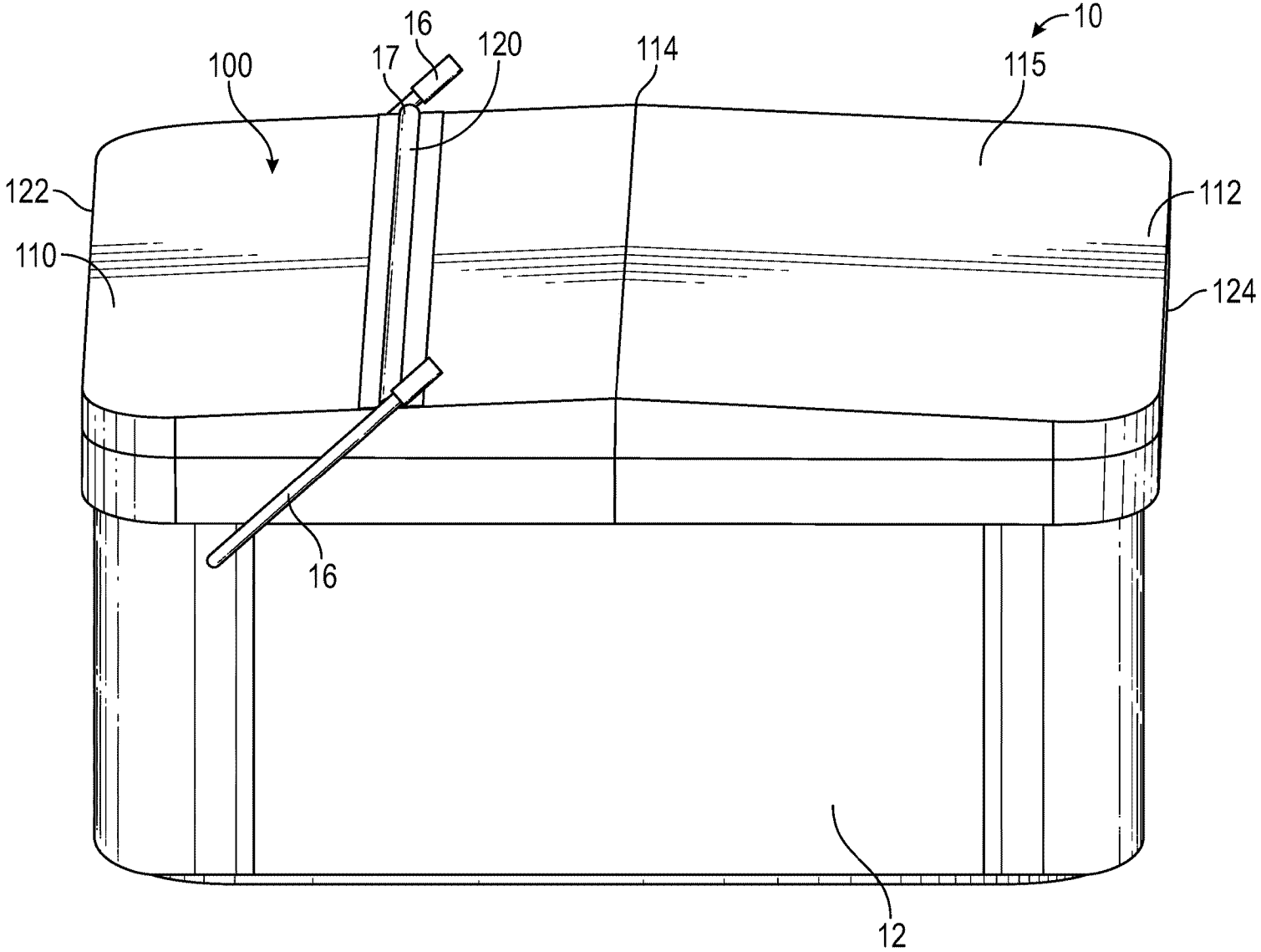
FIG. 1 is a perspective view of a spa having a cover in accordance with an embodiment of the present invention, illustrating the cover assembly in a covered position.

Referring to FIG. 1, a spa 10 having a cover 100 according to an embodiment of the present invention is shown. The spa 10 may be of any type known in the art and includes a base defining a spa cabinet 12, and an acrylic or plastic shell 14 supported by the base. The spa cabinet 12 serves as the support structure for the spa and may be of any type known in the art, such as framed or sub-frameless. For example, the cabinet 12 may be a sub-frameless spa and may include a pair of end member, a pair of side members, and a base member. While the spa shell 14 is preferably formed from acrylic, it may be formed from any suitable plastic material or other impermeable material suitable for holding water. In addition, while the spa 10 is illustrated as being substantially rectangular in shape, other shapes are also envisioned.

As further illustrated in FIG. 1, the spa 10 includes a lifting mechanism that is operable by a user to move the cover 100 between covered and uncovered positions. The lifting mechanism includes a pair of lifter arms 16 pivotally connected to opposed sides of the spa 10 adjacent to the corners thereof, and which connect to a pair of opposed lift-assist mechanisms positioned inside the base 12. A substantially rigid connecting rod or pole 17 extends between the opposed arms 16 adjacent to respective distal ends thereof to rigidly connect the arms 16 to one another. The internal lifting mechanism is more fully described in U.S. patent application Ser. No. 14/713,193, which is incorporated by reference herein in its entirety. As disclosed in the '193 application, the lift-assist mechanism may include a pneumatic or gas spring, although other lift-assist mechanisms may also be utilized without departing from the broader aspects of the present invention.

Figure 2:
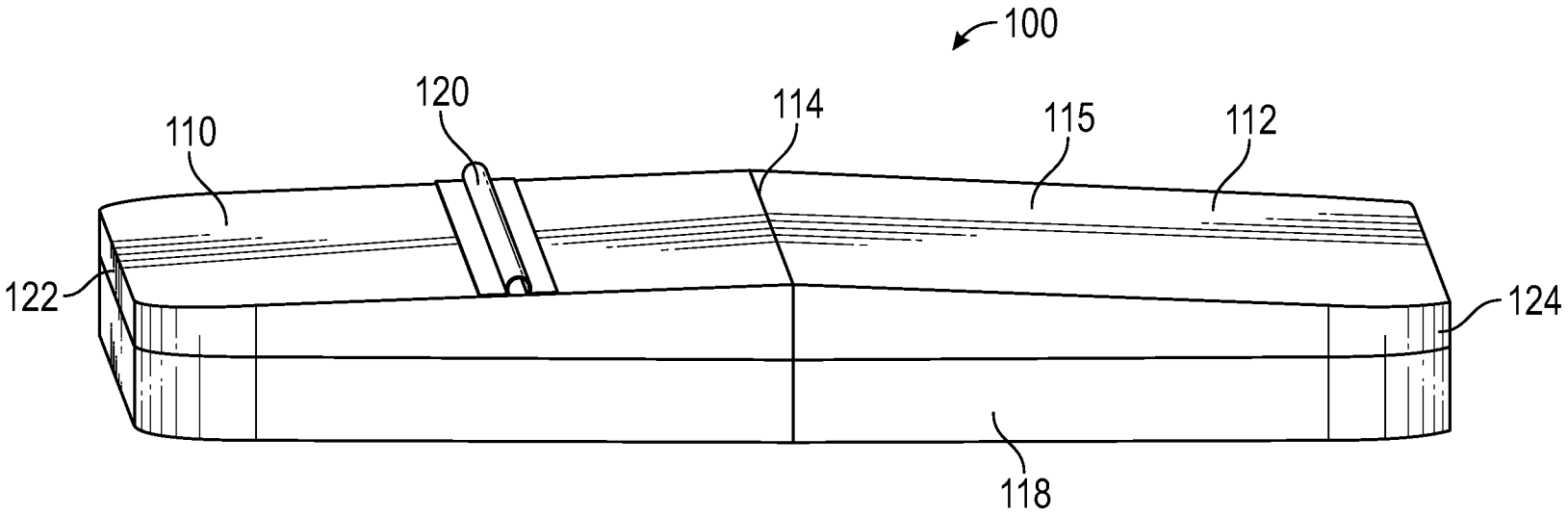
FIG. 2 is a perspective view of the cover according to an embodiment of the present invention.
Figure 3:
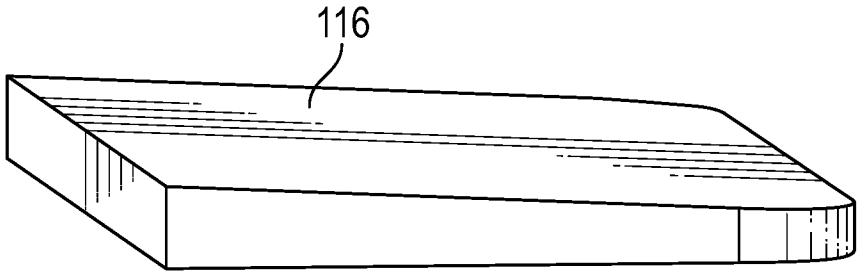
FIG. 3 is a perspective view of a core of a portion of the cover of FIG. 2.
Figure 4:
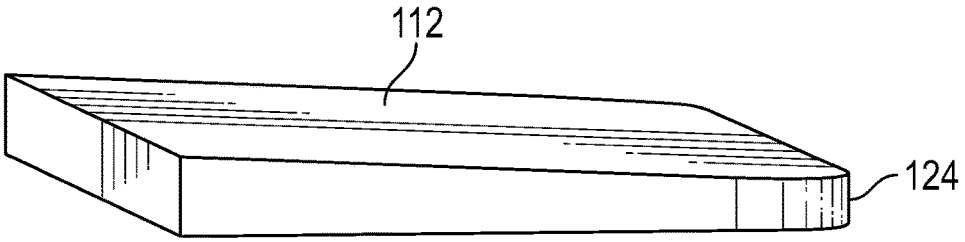
FIG. 4 is a perspective view of a portion of the cover of FIG. 2.
Figure 5:
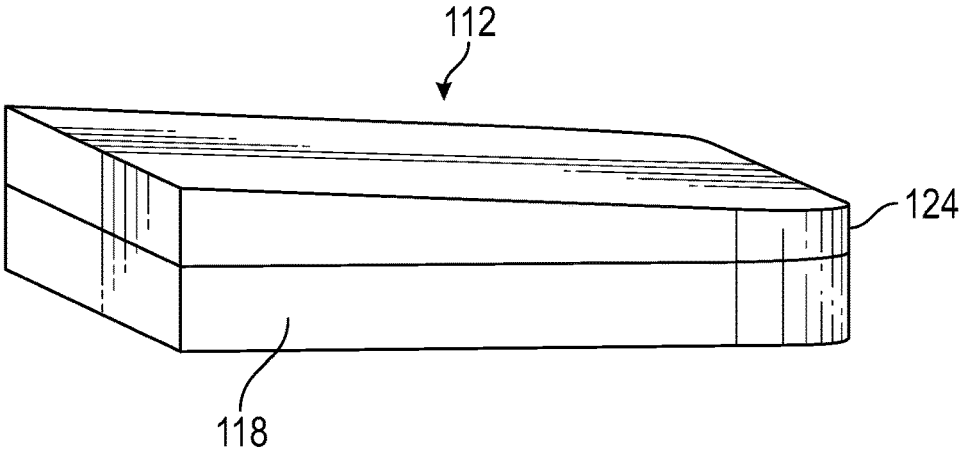
FIG. 5 is another perspective view of a portion of the cover of FIG. 2, with a skirt.

Referring now to FIGS. 1 and 2, the cover 100 includes cover members or halves 110, 112 joined together by a seam 114 (defining a fold or hinge) formed in the covering material 115 or fabric of the cover 100. As illustrated in FIGS. 3 and 4, each cover member half 110, 112 of the cover 100 is comprised of a foam core 116 enclosed by the covering material. As shown in FIGS. 1, 2 and 5, the covering material extends downwardly, past the foam core 116, to define a fabric skirt 118 that covers the interface between the cover 100 and the top lip of the shell 14 of the spa 10 when the cover 100 is placed atop the shell 14. To insulate against heat loss the foam core is normally several inches thick and is formed from any of the many known insulating foams commercially available. As best illustrated in FIGS. 3-5, the cover 100 is thicker at the center point along the seam 114 and tapers slightly towards the outer edges 122, 124 of each half 110, 112. This taper allows for runoff of rainwater and prevents standing pools of water from forming on the cover 100.

Figure 6:
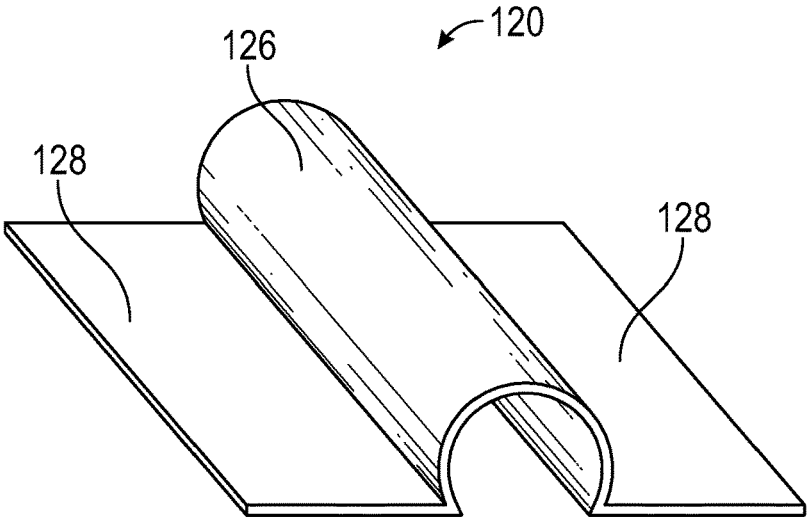
FIG. 6 is a detail, perspective view of a lifter pole-receiving sleeve of the cover.

As illustrated in FIGS. 1 and 2, the cover 100 also includes a sleeve 120 atop the cover 100 that extends from one side of the cover 100 adjacent to one lifter arm 16, to the other side of the cover 100 adjacent to the opposed lifter arm 16. Alternatively, the sleeve 120 could be positioned on the underside of the cover 100, as discussed in detail below. Importantly, the sleeve 120 is located at an approximate midpoint between the outer edge 122 of the cover half 110 and the seam 114. The sleeve 120 is configured to receive the connecting rod 17 of the lifting mechanism that connects the opposed lifter arms 16. As best shown in FIG. 6, the sleeve 120 may be formed from a piece of cover material and preferably includes a channel portion 126 and opposed flange portions 128. In the preferred embodiment, the sleeve 120 flanges 128 may be sewn to the cover half 110 to affix the sleeve 120 to the cover. In other embodiments, the sleeve 120 may be glued to or integrally formed with the cover material of the cover 100.

Figure 7:
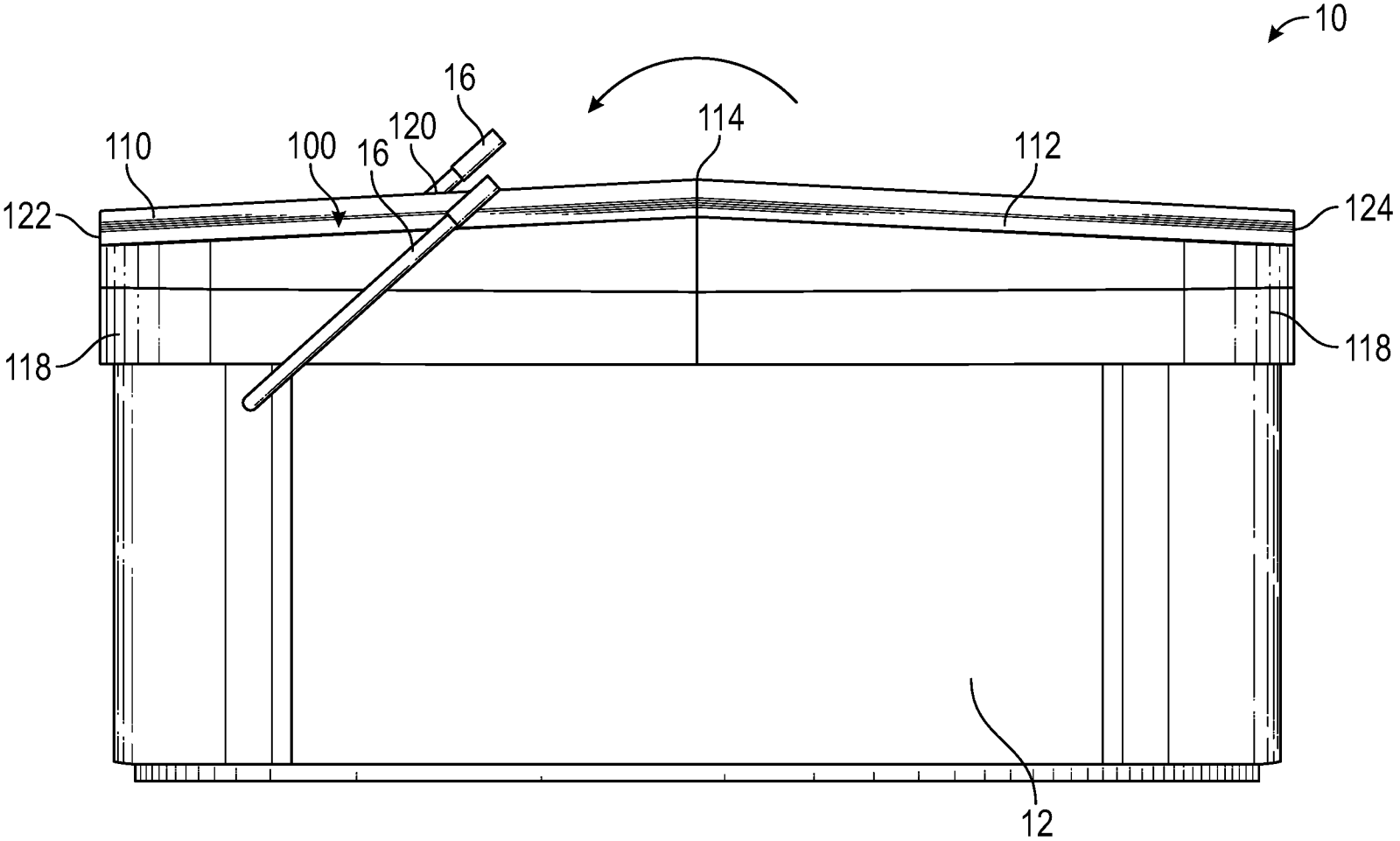
FIG. 7 is a side elevational view of the spa of FIG. 1, illustrating the cover in the covered position.
Figure 8:
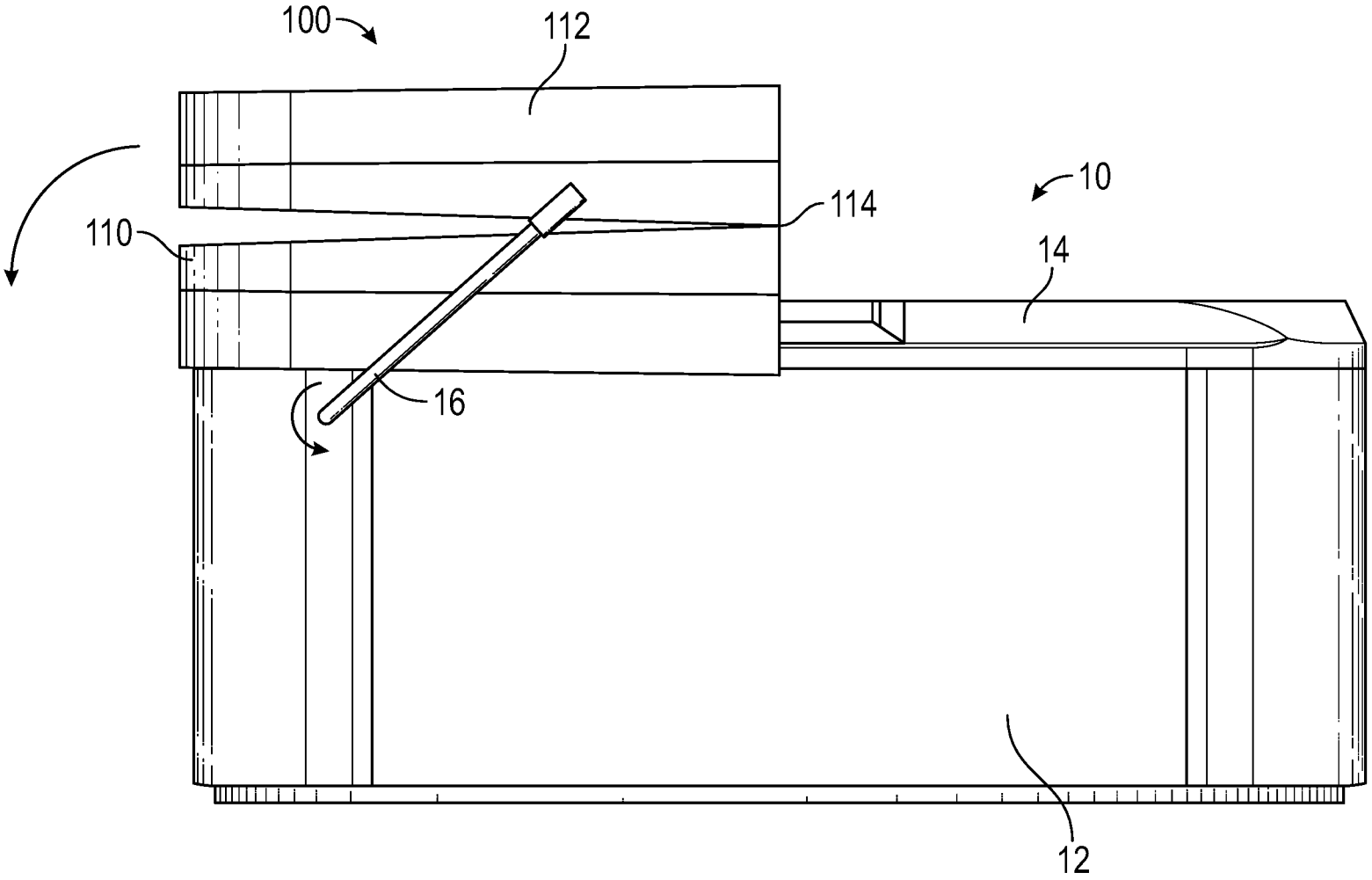
FIG. 8 is a side elevational view of the spa of FIG. 1, illustrating the cover in a partially uncovered position.
Figure 9:
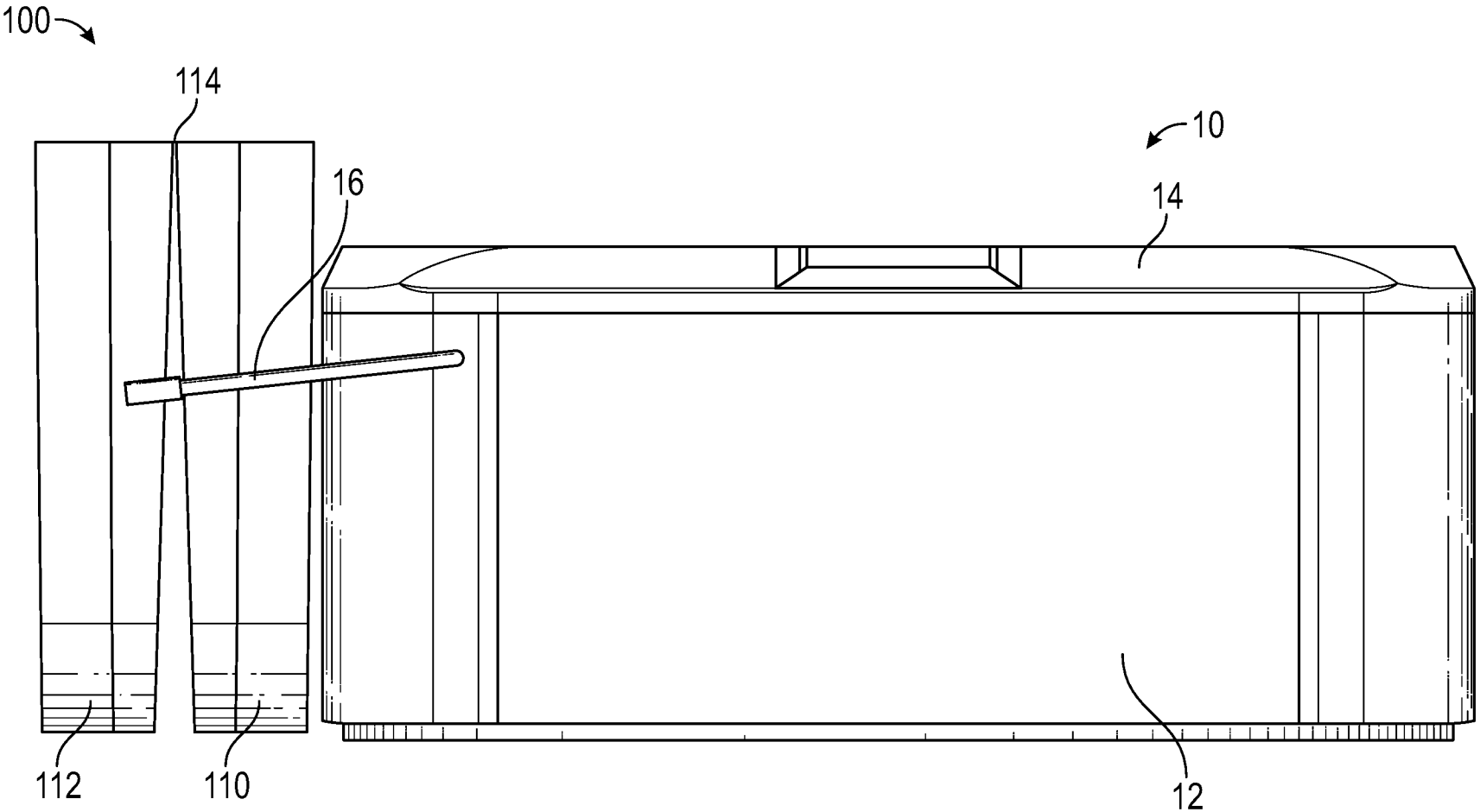
FIG. 9 is a side elevational view of the spa of FIG. 1, illustrating the cover in a fully uncovered position.

Turning now to FIGS. 7-9, operation of the cover 100 is illustrated. In the closed position shown of FIG. 7, the cover 100 rests atop the shell 14 of the spa 10. To uncover the spa, a user first lifts up upon the cover half 112 opposite the lifter arms 16 and flips the cover half 112 over about seam 114 until the cover half 112 rests atop cover half 110, as illustrated in FIG. 8. A user may then grasp the distal handle of one of the lifting arms 16 and rotate the lifting arm 16 about its pivot point with respect to the base (e.g., counterclockwise in FIG. 8). Due to the capturing of the connecting rod within the sleeve 120, rotation of the lifting arms 16 causes the cover 100 to correspondingly move in the direction of the arrow, as shown in FIG. 8, until the cover 100 drops to the fully uncovered position shown in FIG. 9. During this uncovering operation, the lift-assist mechanisms (not shown) positioned within the base 12 exert a generally upwards, uncovering force, on the cover 100, as more clearly shown and described in the '193 application.

In order to cover the spa 10, the procedure described above may simply be reversed. During the covering operation, the lift-assist mechanism is configured to exert an upwards biasing force on the cover 100 to assist a user in bringing the cover 100 atop the shell 14, as more fully shown and described in the '193 application.

As indicated above, the positioning of the sleeve 120 at a general midpoint between the edge 122 of the cover half 110 and the seam 114 is an important aspect of the present invention. In particular, this configuration allows the cover 110 to drop fully to the ground during uncovering, in contrast to existing covers which typically sit in the air and extend a fair amount above the top lip of the base when in the uncovered position. In addition, this configuration allows the cover 100 to sit closely against the end wall of the base 12 when in the uncovered position, eliminating the need for a substantial amount of space or clearance surrounding the spa 10. Both of these features, being able to bring the cover 100 to the ground, and stowing the cover 100 closely against the end of the base 12, provide for a cleaner, more attractive appearance. Coupled with the internally-mounted lift-assist mechanism, the spa 10 is therefore much more aesthetically pleasing than existing spas.

In addition to the above-described advantages, utilizing a single lifting mechanism (i.e., on one end of the spa) for the entire cover allows for a reduction in manufacturing and installation costs. In connection with this, the positioning of the lifting mechanism at one end of the spa adjacent to the corners thereof provides for increased accessibility should servicing of the spa be required. In particular, utilizing a single lifting mechanism at one end of the spa leaves the rest of the base 12 free from moving parts or other operational components, which opens space for access doors and other accessories.

Figure 10:
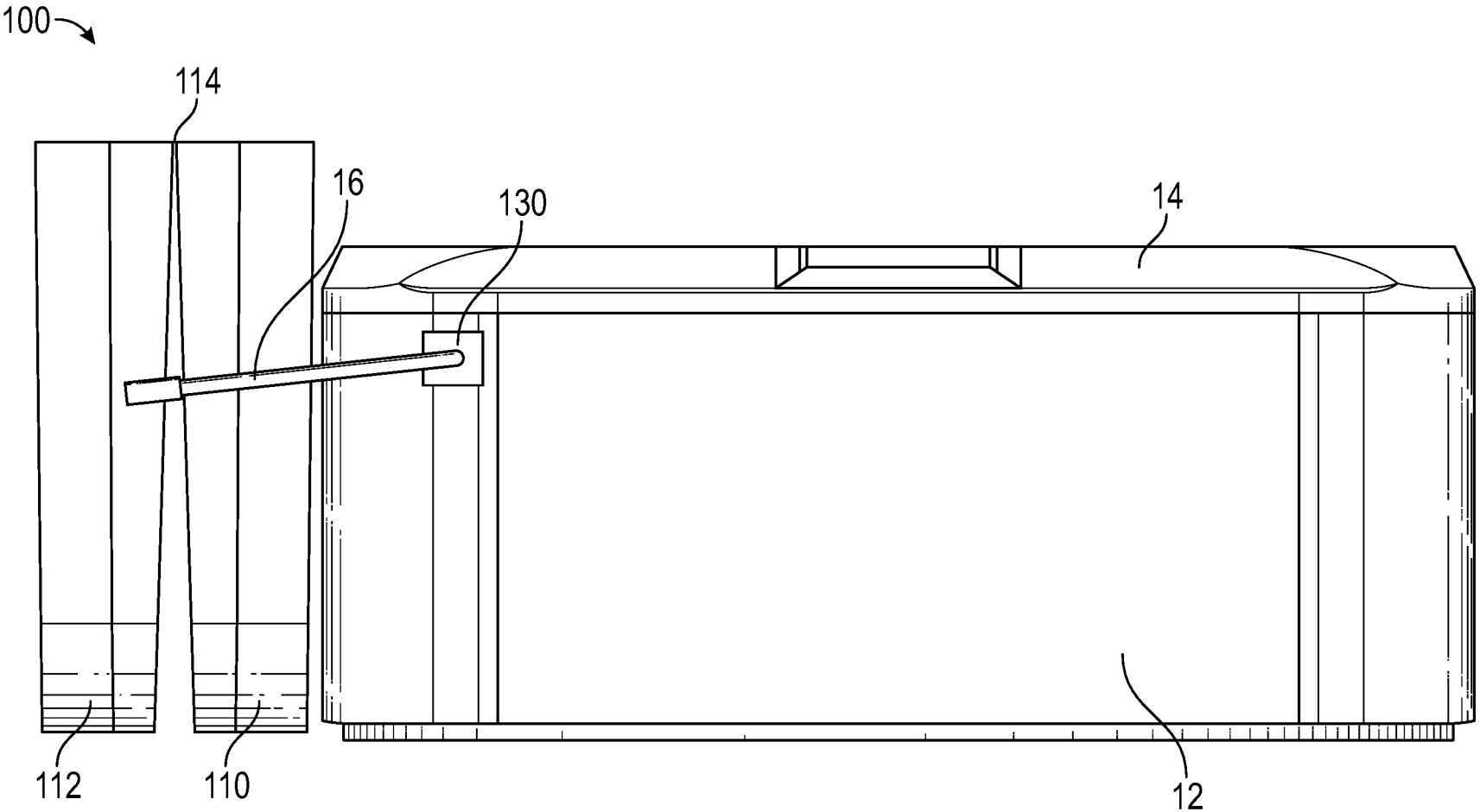
FIG. 10 is a side elevational view of a spa having an external lifting mechanism, illustrating the cover thereof in a fully uncovered position.
Figure 11:
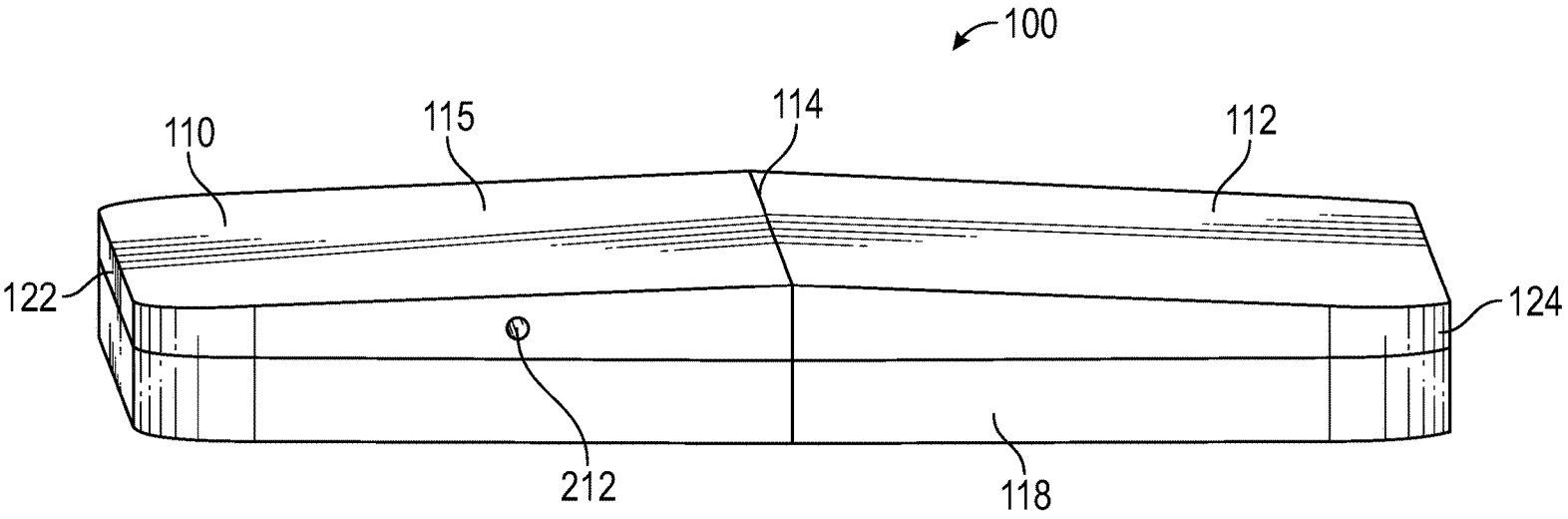
FIG. 11 is a perspective view of a cover for a spa according to another embodiment of the present invention.
Figure 12:
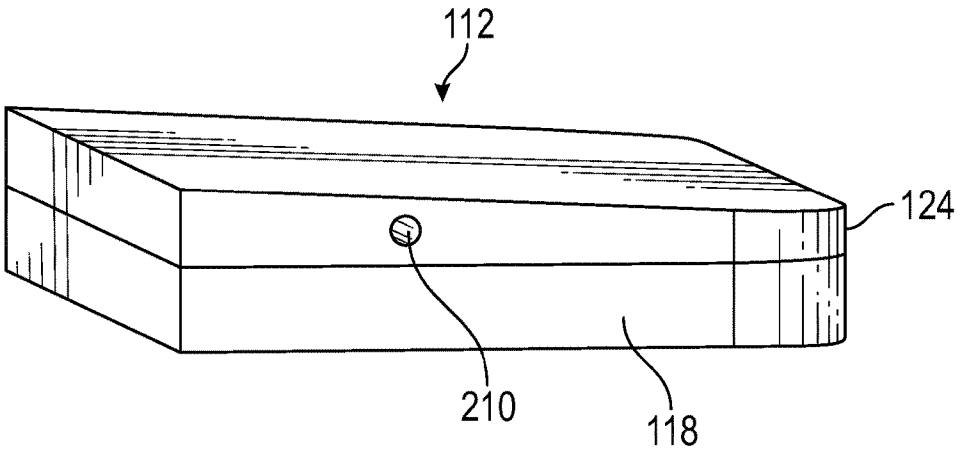
FIG. 12 is a top, perspective view of a portion of the cover of FIG. 11.
Figure 13:
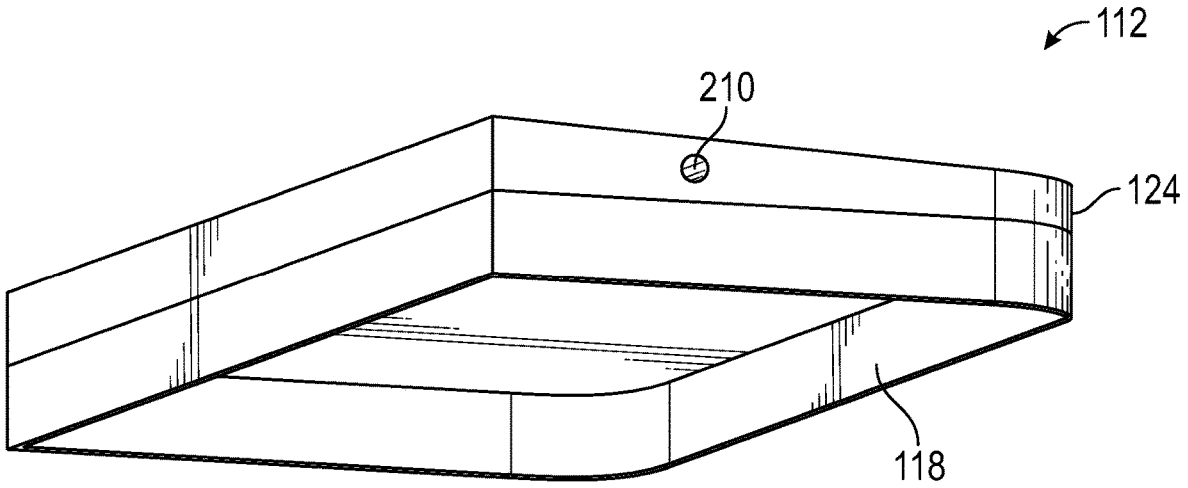
FIG. 13 is bottom, perspective view of a portion of the cover of FIG. 11.
Figure 14:
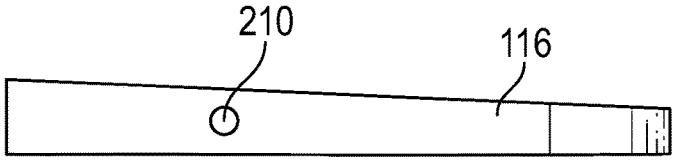
FIG. 14 is a perspective view of a foam core of the cover of FIG. 11.
Figure 15:
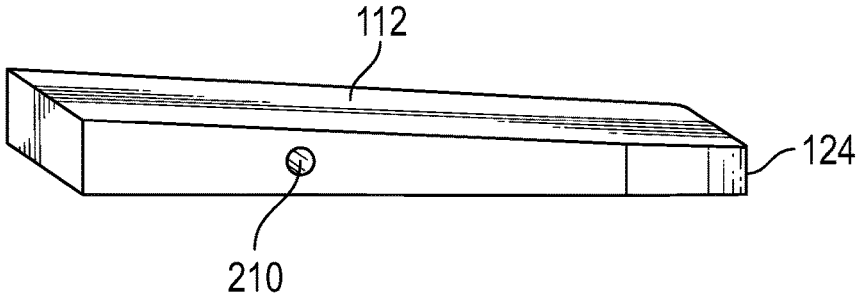
FIG. 15 is a perspective view of a portion of the cover of FIG. 11.

Turning now to FIG. 10, the cover 100 of the present invention may also be utilized with an externally-mounted lift-assist mechanism 130 (rather than the internally-mounted lift-assist mechanism). An exemplary externally-mounted lift-assist mechanism is more fully described in the '193 application.

Figure 16:
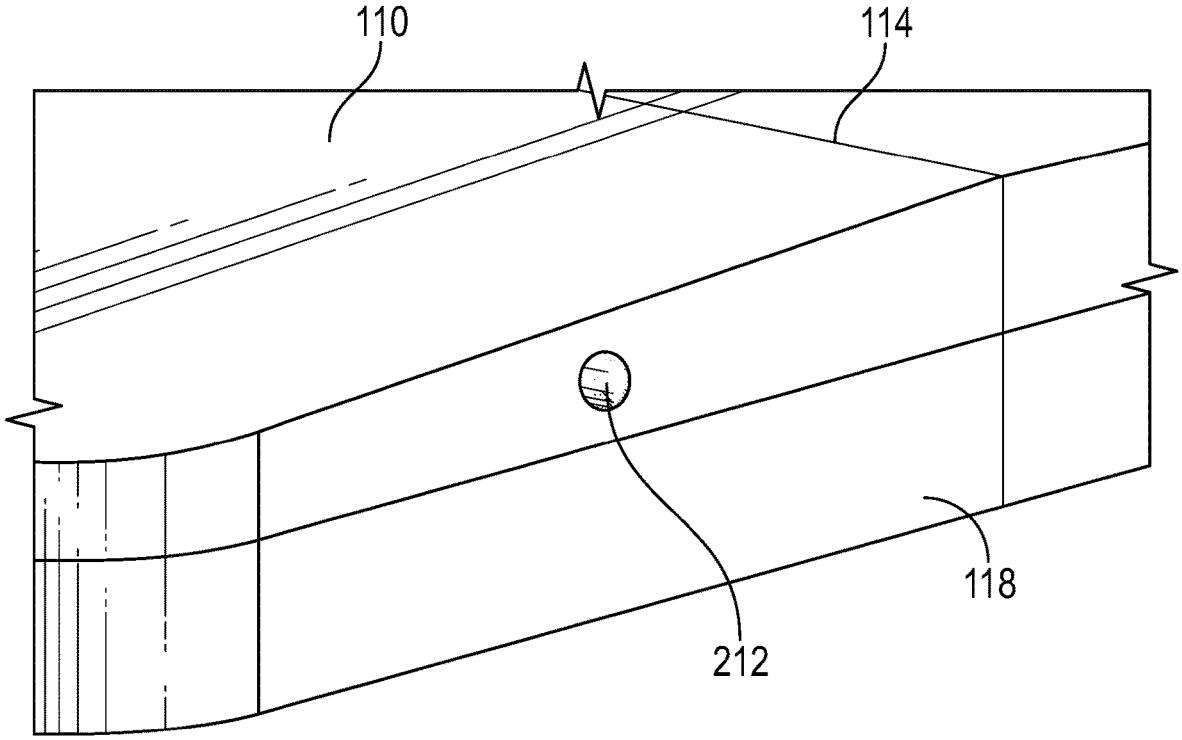
FIG. 16 is an enlarged, perspective view of a portion of the cover of FIG. 11, illustrating a lifter pole-receiving guide.
Figure 17:
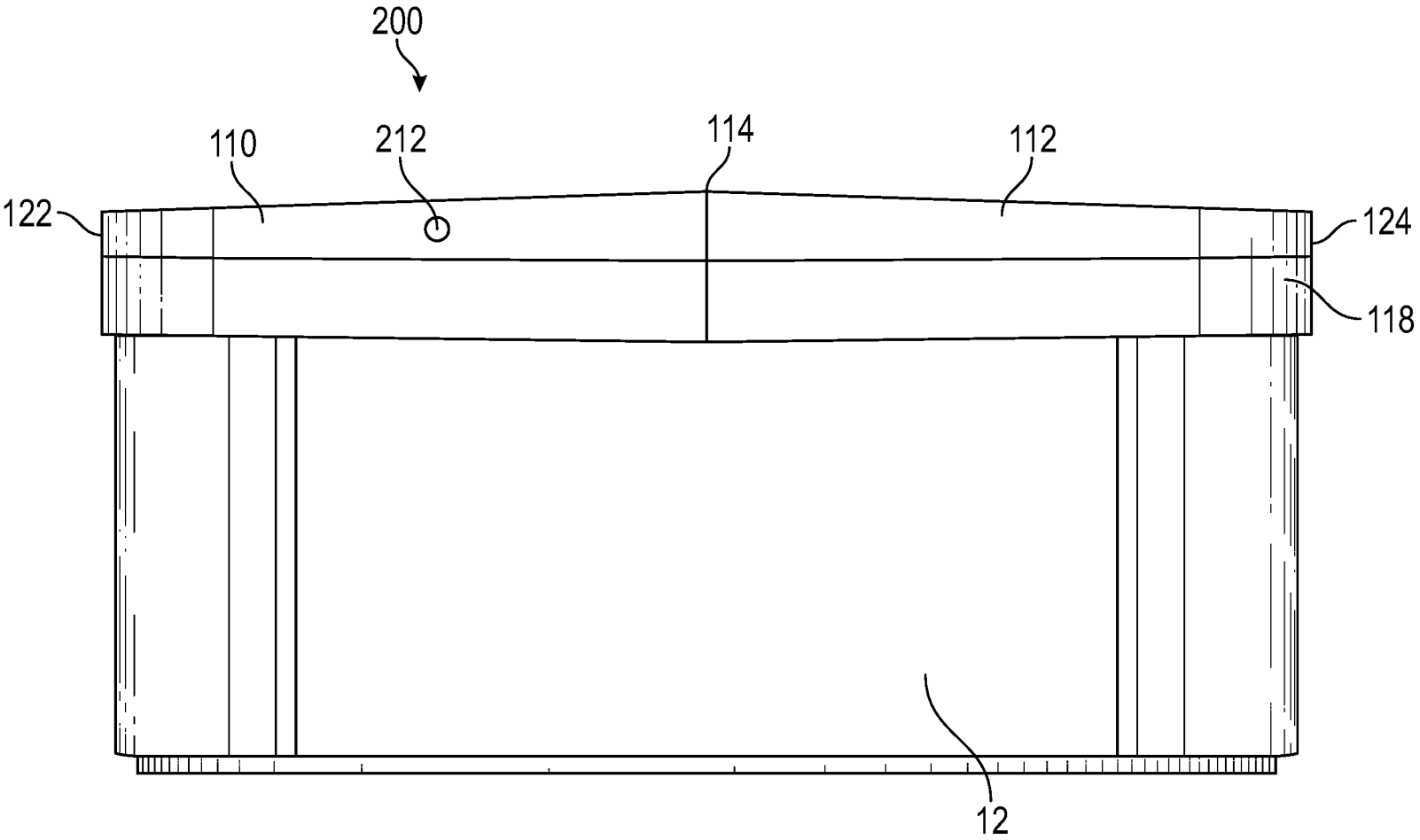
FIG. 17 is a side elevational view of the cover of FIG. 11, shown in a covered position atop a spa.

With reference to FIGS. 11-17, a cover 200 according to another embodiment of the present invention is illustrated. Cover 200 is substantially similar in many respects to the cover 100 described above in connection with FIGS. 1-10, where like reference numerals designate like parts, however it differs in the manner in which it is coupled to the lifting mechanism. In particular, rather than having a sleeve for receiving the connecting rod of the lifting mechanism, one of the halves 110, 112 has an aperture 210 extending therethrough from one side of the cover 200 adjacent to one lifter arm 16, to the other side of the cover 100 adjacent to the opposed lifter arm 16 (i.e., through the cover material and the foam core 116). Importantly, as with the sleeve 120, the aperture 210 extends through the cover half 110 at an approximate midpoint between the outer edge 122 of the cover half 110 and the seam 114. The aperture 210 receives hollow guide 212, as best illustrated in FIG. 16. In an embodiment the hollow guide 212 may be a PVC pipe or similar hollow member. The guide 212 is configured to receive the connecting rod 17 of the lifting mechanism so that rotational motion of the lifter arms 16 about their respective pivot points with the spa base may be imparted to the cover 200. In other embodiments, the connecting rod may extend directly through the cover half 110 without the use of a guide.

Figure 18:
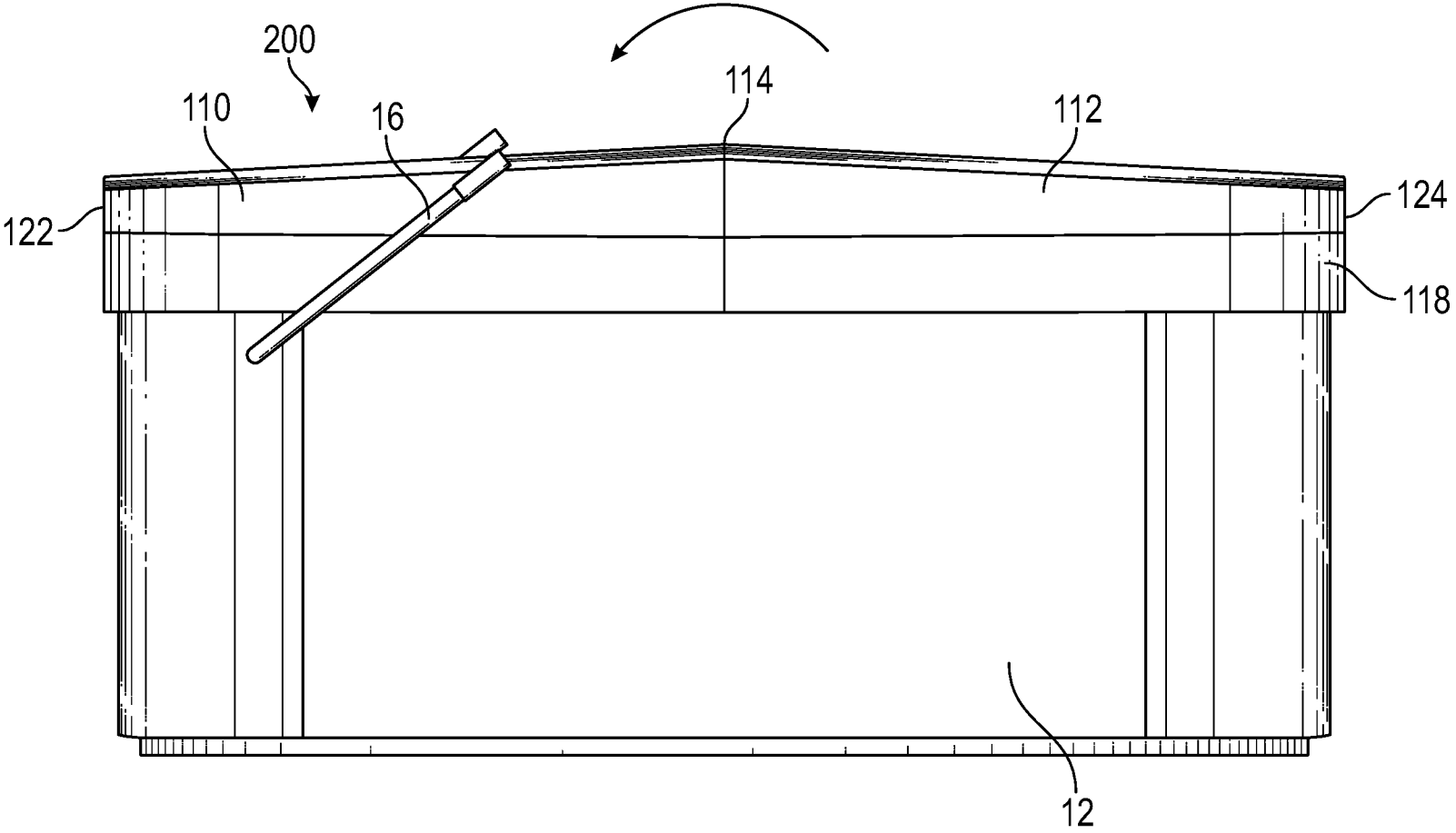
FIG. 18 is a side elevational view of the cover of FIG. 11, shown in a covered position atop a spa and in association with an internally-mounted lifting mechanism.
Figure 19:
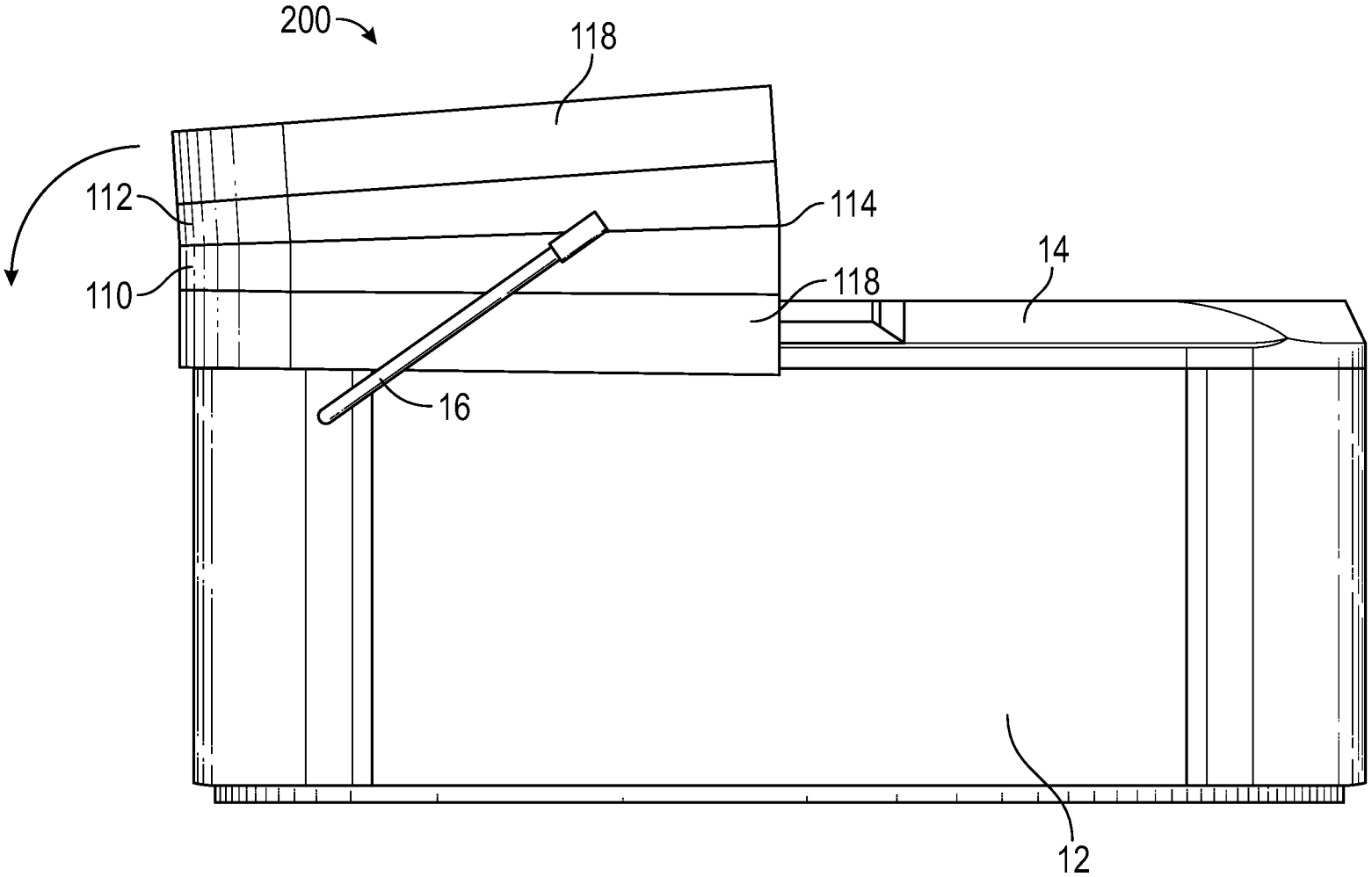
FIG. 19 is a side elevational view of the cover of FIG. 11, shown in a partially uncovered position.
Figure 20:
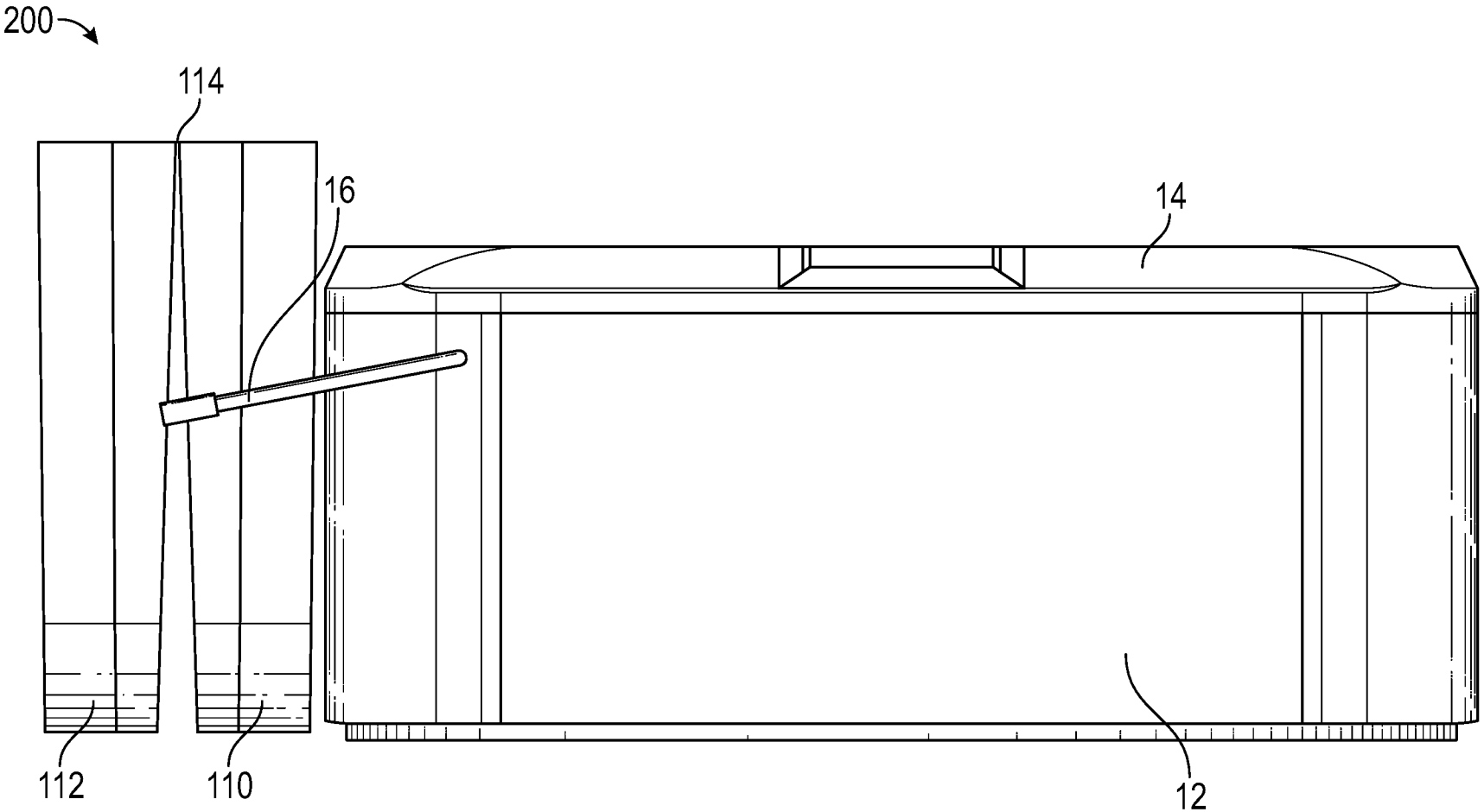
FIG. 20 is a side elevational view of the cover of FIG. 11, shown in a fully uncovered position.

Turning now to FIGS. 18-20, operation of the cover 200 is illustrated. In the closed position shown of FIG. 18, the cover 200 rests atop the shell 14 of the spa 10. To uncover the spa, a user first lifts up upon the cover half 112 and flips the cover half 112 over about seam 114 until the cover half 112 rests atop cover half 110, as illustrated in FIG. 19. A user may then grasp the distal handle of one of the lifting arms 16 and rotate the lifting arm 16 about its pivot point with respect to the base (e.g., counterclockwise in FIG. 19). Due to the capturing of the connecting rod 17 within the PVC guide 212, rotation of the lifting arms 16 causes the cover 200 to correspondingly move in the direction of the arrow, as shown in FIG. 19, until the cover 200 drops to the fully uncovered position shown in FIG. 20. During this uncovering operation, the lift-assist mechanisms (not shown) positioned within the base 12 exert a generally upward, uncovering force, on the cover 200, in the manner indicated above.

In order to cover the spa 10, the procedure described above may simply be reversed. During the covering operation, the lift-assist mechanism is configured to exert an upwards biasing force on the cover 200 to assist a user in bringing the cover 200 atop the shell 14, as described above.

Figure 21:
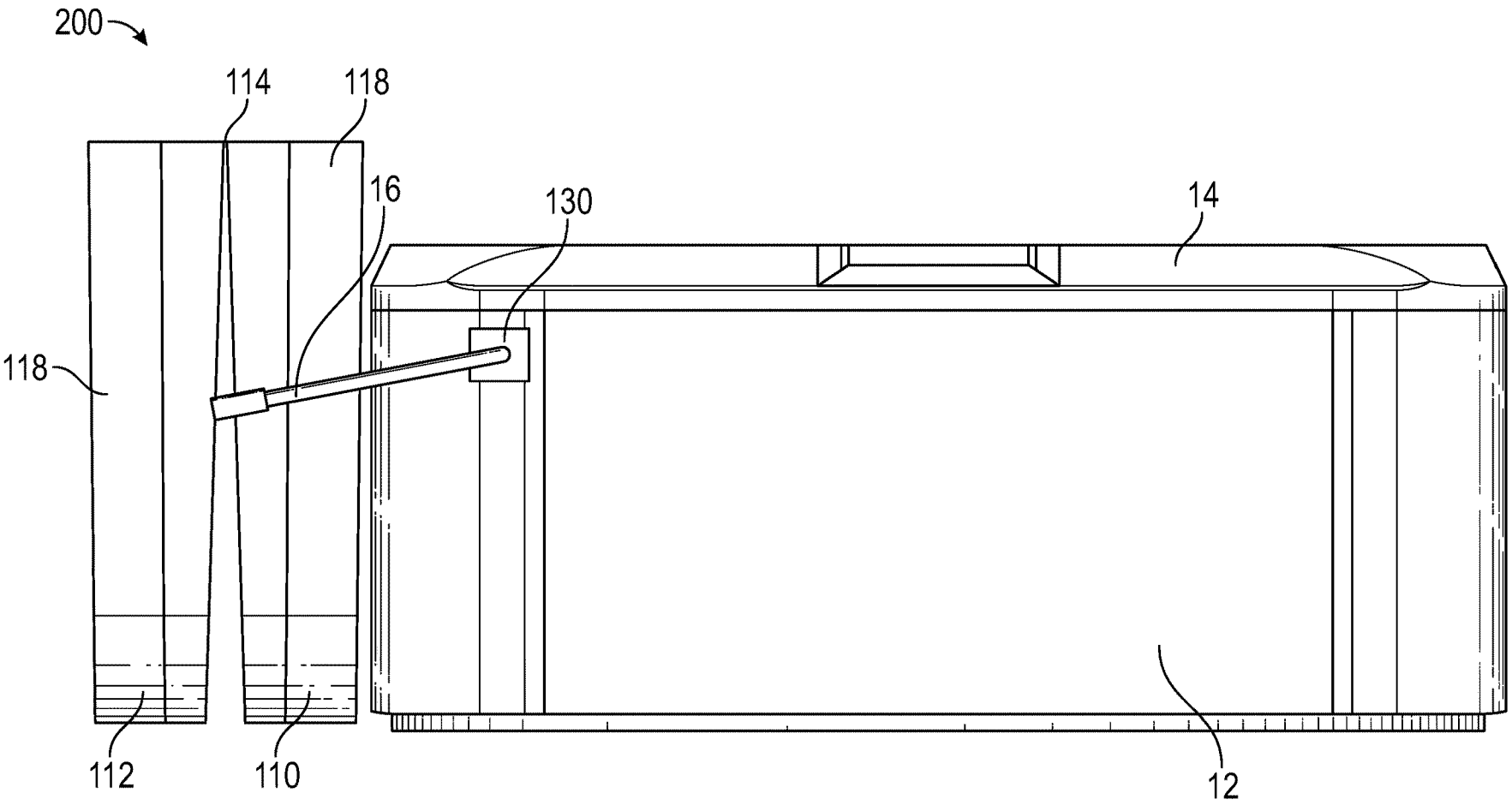
FIG. 21 is a side elevational view of the cover of FIG. 11, shown in a fully uncovered position adjacent to the side of a spa and in association with an externally-mounted lifting mechanism.
Figure 22:
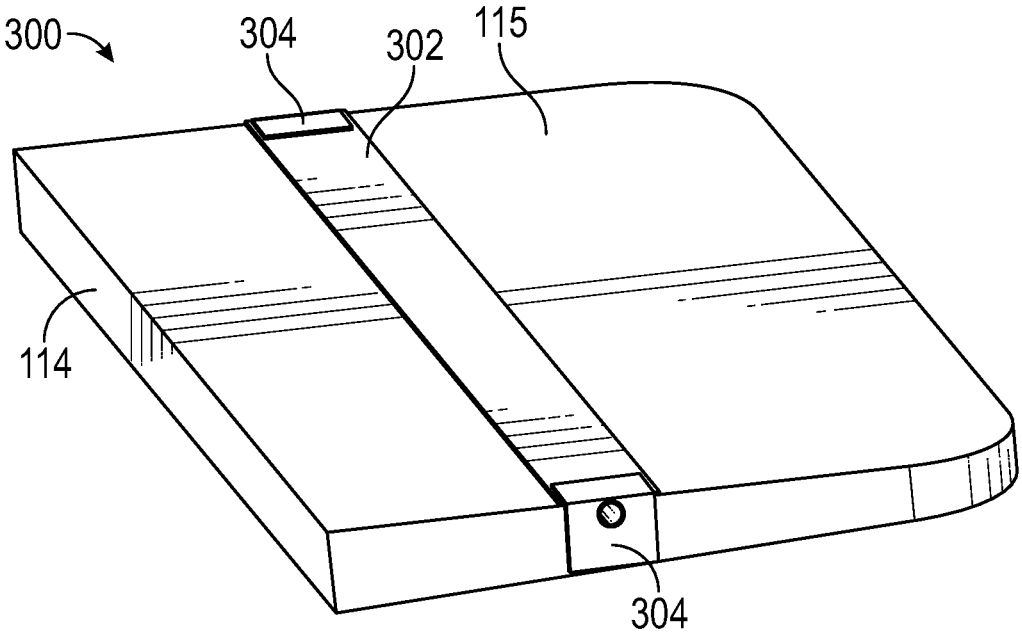
FIG. 22 is a perspective view of a half of a cover, illustrating a mechanism for connecting the cover to a lifting mechanism according to another embodiment of the present invention.

Turning now to FIG. 21, the cover 200 of the present invention, like cover 100, may also be utilized with an externally-mounted lift-assist mechanism 130 (rather than the internally-mounted lift-assist mechanism). The externally-mounted lift assist mechanism 130 may, in an embodiment, includes a torsional coil spring.

Figure 23:
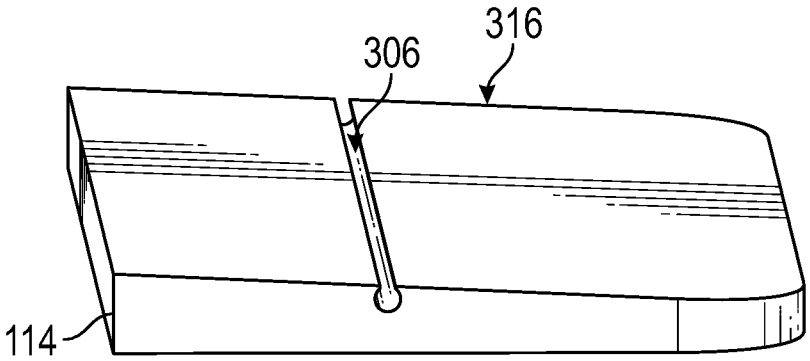
FIG. 23 is a perspective view of a core of the cover of FIG. 22.

Referring finally to FIGS. 22-26, an alternative configuration for cover halves 110, 112 is shown in the form of cover half 300. Cover half 300 is generally similar to the covers 100, 200 described above, where like reference numerals designate like parts, however it differs in the manner in which it is coupled to the lifting mechanism. The cover half 300 includes a foam core 316 enclosed by a covering material 115, an inverted sleeve 302, and a pair of opposed side supports 304. As shown in FIG. 23, the foam core 316, like that of FIGS. 11-17, has a channel 306 or through aperture formed therein which extends from one side of the cover half to the other. Unlike the configuration shown in FIGS. 11-17, however, the channel 306 is not bounded along its entire periphery by foam material. In particular, as shown therein, an upper portion of the channel 306 defines an opening that is configured to receive inverted sleeve 302 therein. In an embodiment, the opening is approximately 1 inch wide throughout the length of the channel 306. In an embodiment, the channel 306 is located approximately 17 inches from fold edge 114 for an 85 inch×85 inch cover, and approximately 18 inches from the fold edge 114 for a 91 inch×91 inch cover.

Figure 24:
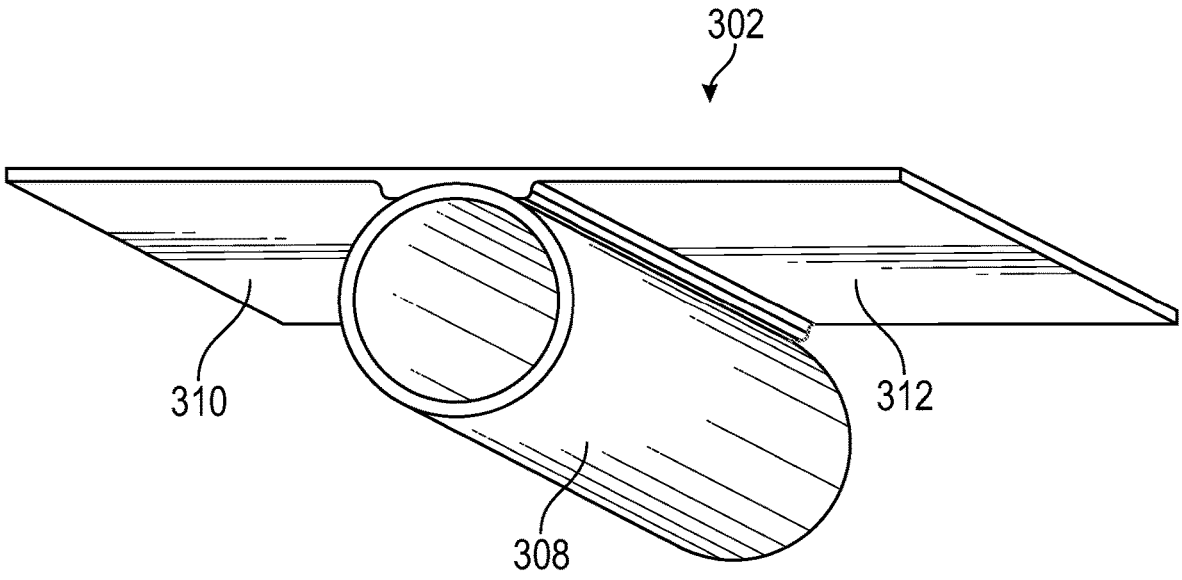
FIG. 24 is a perspective view of an inverted loop of the cover of FIG. 22.

With reference to FIG. 24, the inverted sleeve 302 includes a cylindrical loop 308 sewn or otherwise affixed to a piece of material (which may be the same as cover material 115) that defines joining flanges 310, 312. In an embodiment, the loop 308 and flanges 310, 312 may be manufactured from a single piece of 12-inch wide material. The length of the inverted sleeve 302, including flanges 310, 312 and loop 308 is approximately equivalent to the length of channel 306 in the foam core 316. In an embodiment, the combined width of the flanges 310, 312 may be approximately 6 inches, and the inner diameter of the channel 308 may be approximately 0.688 inches.

Figure 25:
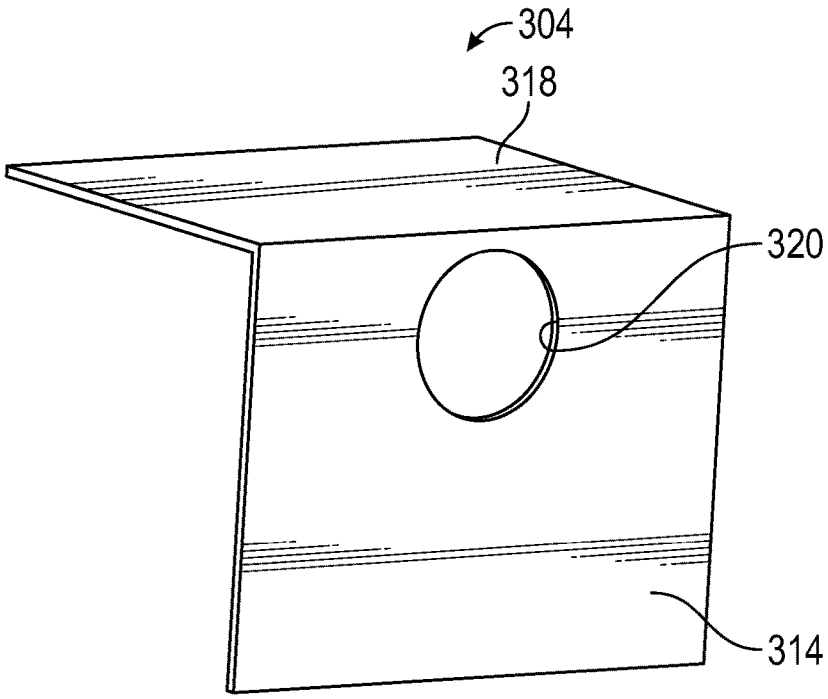
FIG. 25 is a perspective view of a side support of the cover of FIG. 22.

Turning now to FIG. 25 the configuration of the side supports 304 is shown. The side supports are generally rectangular in shape and have a side portion 314 and a top portion 318 that extends at an approximate 90 degree angle from the side portion 314. The side portion 314 has an aperture 320 sized and shaped to correspond to the size and shape of the loop 308 of the inverted sleeve 302.

Figure 26:
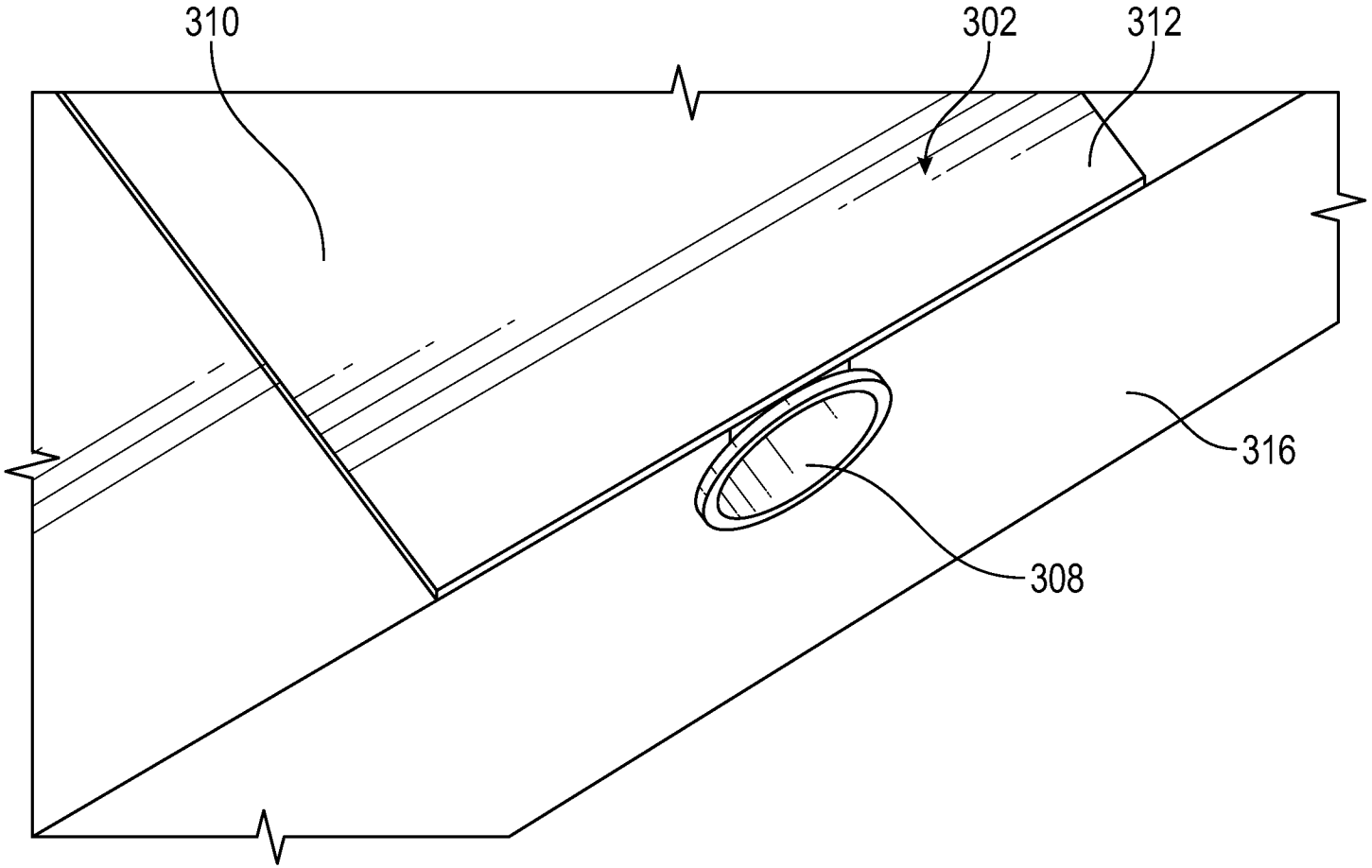
FIG. 26 is an enlarged, detail view of the inverted loop received within a channel of the core, showing an intermediate assembly state.

As best shown in FIG. 26, the loop 308 of the inverted sleeve 302 is configured to be received within the channel 306 in the foam core 316 by inserting it through the top opening. The flanges 310, 312 of sleeve 302 the may then be sewn to the cover material 115. Finally, the side supports 304 may likewise be sewn to the cover material. As described above, the connecting rod 17 of the lifting mechanism is received through the loop 308 of the inverted sleeve 302 so that rotational motion of the lifter arms 16 about their respective pivot points with the spa base may be imparted to the cover 300. As will be readily appreciated, therefore, the cover 300 is essentially a hybrid of those shown and described in connection with FIGS. 1-10 and 11-17, respectively.

In the preferred embodiment, the inverted sleeve 302 and side supports 304 may be sewn to the underside of the cover material 115 in order to hide the same, thereby improving the aesthetics of the cover, as a whole.

While the covers 100, 200 of the present invention have been shown and described as being of the soft-cover type, having a foam core covered in a covering material, the present invention is not so limited in this regard. In particular, it is contemplated that the cover of the present invention may alternatively be of the hard-cover type, in which case each half of the cover may be formed from a substantially rigid shell connected to one another through a seam or other hinge-like structure enabling one half to be folded atop the other half.

Moreover, while the covers 100, 200 have been shown and described as being a single-fold cover (i.e., having a single fold seam 114), it is further envisioned that the cover may a bi-fold, trifold, or other multiple fold cover so long as one portion of the cover contains the lifting mechanism coupling means described herein.

Importantly, the covers of the present invention, and the lifting mechanisms therefor, contain a limited amount of external hardware, improving the aesthetic appearance of the spa, as a whole, as compared to existing systems. The configuration of the cover system provides simple operation, with little or no effort required to cover or uncover the spa.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A spa, comprising:

a base;

a shell supported by the base;

a cover receivable atop the shell, the cover including:

a first cover member;

a second cover member, the first cover member and the second cover member being connected to one another by a cover material such that the second cover member is foldable atop the first cover member about a fold line; and a connecting rod receiving channel associated with the first cover member and extending from one side of the first cover member to an opposing side of the first cover member in a direction parallel to the fold line, and located at a midline of the first cover member between the fold line and an edge of the first cover member opposite the fold line; and a lifting mechanism including a pair of opposed lifting arms pivotally coupled to opposing sides of the base at respective pivot points located above a midline between a bottom edge and a top edge of the base, and being joined together by a connecting rod that is received in the connecting rod receiving channel, at least one of the opposed lifting arms having a distal end defining a gripping handle that extends above a top surface of the first cover member and above the connecting rod;

wherein the connecting rod receiving channel extends through the first cover member and defines an opening in a top surface of the first cover member;

wherein the cover further includes an inverted sleeve having a flange portion and a loop attached to an underside of the flange portion;

wherein the loop is received in the connecting rod receiving channel and the flange portion extends through the opening and is attached to the cover material;

wherein the connecting rod is received in the loop;

wherein the flange portion is attached to the cover material such that the inverted sleeve is not visible from a top of the cover and such that the top surface of the first cover member is planar over an entire area of the top surface of the first cover member; and wherein the sleeve is formed from the same material as the cover material and is sewn to the cover material.

2. The spa of claim 1, wherein:

the flange portion is attached to an underside of the cover material such that the inverted sleeve is not visible from a top of the cover and such that the top surface of the first cover member is planar over an entire area of the top surface of the first cover member.

3. The spa of claim 2, wherein:

the cover further includes a pair of opposed side supports each having an aperture that is aligned with opposing ends of the loop.

4. The spa of claim 1, wherein:

the first cover member and the second cover members include each include a foam core.

5. The spa of claim 1, wherein:

the opposed lifting arms of the lifting mechanism are pivotally connected to the base such that the opposed lifting arms extend horizontally when the first cover member and the second cover member are in an uncovered position.

6. A cover for a spa, comprising:

a first cover member;

a second cover member;

a cover material covering the first cover member and the second cover member, the cover material also connecting the first cover member to the second cover member and defining a hinge line intermediate the first cover member and the second cover member along which the second cover member is pivotable to permit folding of the second cover member atop the first cover member; and a connecting rod receiving channel associated with the first cover member and extending from one side of the first cover member to an opposing side of the first cover member in a direction parallel to the hinge line, and located at a midline of the first cover member between the hinge line and an edge of the first cover member opposite the hinge line;

wherein the connecting rod receiving channel is configured to receive a connecting rod of a lifting mechanism there through;

wherein the connecting rod receiving channel extends through the first cover member and defines an opening in a top surface of the first cover member;

wherein the cover further includes a sleeve having a flange portion and a loop attached to an underside of the flange portion;

wherein the loop is received in the connecting rod receiving channel and the flange portion extends through the opening and is attached to the cover material;

wherein the connecting rod is received through the loop;

wherein the flange portion is attached to the cover material such that the sleeve is not visible from a top of the cover and such that the top surface of the first cover member is planar over an entire area of the top surface of the first cover member;

wherein the sleeve is formed from the same material as the cover material and is sewn to the cover material.

7. The cover of claim 6, wherein:

the first cover member and the second cover members include each include a foam core enclosed by the cover material.

8. A spa, comprising:

a base;

a shell supported by the base;

a cover receivable atop the shell, the cover including:

a first cover member;

a second cover member, the first cover member and the second cover member being connected to one another by a cover material such that the second cover member is foldable atop the first cover member about a fold line; and a connecting rod receiving channel associated with the first cover member and extending from one side of the first cover member to an opposing side of the first cover member in a direction parallel to the fold line, the connecting rod receiving channel being located at an approximate midpoint of the first cover member; and a lifting mechanism including a pair of opposed lifting arms pivotally coupled to opposing side walls of the base at respective pivot points located above a midline between a bottom edge and a top edge of the base, and being joined together by a connecting rod that is received in the connecting rod receiving channel, at least one of the opposed lifting arms having a distal end defining a gripping handle that extends above a top surface of the first cover member and above the connecting rod;

wherein the lifting mechanism is operable to remove both the first cover member and the second cover member from atop the shell to an uncovered position where the first cover member and the second cover member contact and rest on a ground surface;

wherein the connecting rod receiving channel defines an opening in a top surface of the first cover member;

wherein the cover further includes a sleeve having a flange portion and a loop attached to an underside of the flange portion;

wherein the loop is received in the connecting rod receiving channel and the flange portion extends through the opening and is attached to the cover material;

wherein the connecting rod is received through the loop;

wherein the flange portion is attached to the cover material such that the sleeve is not visible from a top of the cover and such that the top surface of the first cover member is planar over an entire area of the top surface of the first cover member;

wherein the sleeve is formed from the same material as the cover material and is sewn to the cover material.

* * * * *